United States Patent [19]

Hilgarth

[11] Patent Number: 4,899,469

[45] Date of Patent: Feb. 13, 1990

[54] DEVICE FOR SECURING A LEG OR LEG COVER ON SKI BOOTS

[75] Inventor: Kurt Hilgarth, Graz, Austria

[73] Assignee: Skischuhfabrik Dynafit Gesellschaft m.b.H., Graz, Austria

[21] Appl. No.: 230,416

[22] Filed: Aug. 10, 1988

[30] Foreign Application Priority Data

Aug. 11, 1987 [AT] Austria ..... 2023/87

[51] Int. Cl.[4] ..... A43B 5/04

[52] U.S. Cl. ..... 36/120; 36/121

[58] Field of Search ..... 36/117–121, 36/50, 105; 24/68 SK

[56] References Cited

U.S. PATENT DOCUMENTS

| | | | |
|---|---|---|---|
| 4,349,971 | 9/1982 | Everst, III | 36/121 |
| 4,499,676 | 2/1985 | Chalmers, II | 36/120 |
| 4,519,150 | 5/1985 | Arieh et al. | 36/121 |
| 4,575,958 | 3/1986 | Arieh et al. | 36/121 |
| 4,761,899 | 8/1988 | Marxer | 36/121 |

FOREIGN PATENT DOCUMENTS

| | | | |
|---|---|---|---|
| 549970 | 6/1974 | Switzerland | 36/121 |

*Primary Examiner*—James Kee Chi

*Attorney, Agent, or Firm*—Fleit, Jacobson, Cohn, Price, Holman & Stern

[57] ABSTRACT

Device for securing a shaft or shaft cover on ski boots comprising a shell and a leg. At least one part of the leg, when the leg comprises a leg cover and sleeve, is the leg cover which pivots about an axis of the shell or of any leg sleeve transverse to the boot's direction of travel. Located between the leg or cover and the heel section of the shell is a catch which is subjected to a spring force that moves the catch into the closed position and which may be forced open against the spring force acting on the inside of the boot and which is supported over a lower face on the heel section of the shell. In the locked position of the catch the leg or cover under load presses against the catch, which in turn presses against the shell without loading the pivoting pin of the catch.

5 Claims, 1 Drawing Sheet

DEVICE FOR SECURING A LEG OR LEG COVER ON SKI BOOTS

The invention relates to a device for securing a leg or leg cover on ski boots comprising a shell and a leg, at least one part of which, the leg cover, when the leg comprises a leg cover and sleeve, pivots about the axis of a shell or of any leg sleeve transverse to the boot's direction of travel.

In a known ski boot of this type the diameter of the pin is equal to the diameter of the catch bore, the associated drawback being that the downward force of the cover under load acts via the pin on the catch and then on the shell, as a consequence of which, pivoting of the catch is hindered as a result of friction between the pin and the bore in which it is located.

The object of the invention is to devise a way of preventing this drawback.

According to the invention a device for securing a leg or leg cover on ski boots comprising a shell and a cover, at least one part of which, the leg cover, when the leg comprises a leg cover and sleeve, pivots about the axis of a shell or of any leg sleeve transverse to the boot's direction of travel, whereby a catch is provided between the leg or leg cover and the heel section of the shell, which is subjected to a spring force biassing the catch into the closed position and which may be forced open against the spring force acting on the inside of the boot, the catch being designed as a double-armed lever located in a recess of the leg cover and pivoting about a pin in the cover, wherein the diameter of the pin, about which the catch may be pivoted, is smaller than the catch bore in which the pin is located, and the catch features two stop faces each opposite one stop face of the shell or cover, when the catch is in the locked position.

In the preferred embodiment the arm facing away from the catch arm on the shell is located in the area of the arm of a clamping lever, which is hinged on the heel side and which can be pivoted in the plane of the direction of motion.

Additional features of the invention will be described in greater detail with reference to the drawing showing an exemplified embodiment of the invention.

Figure 1:
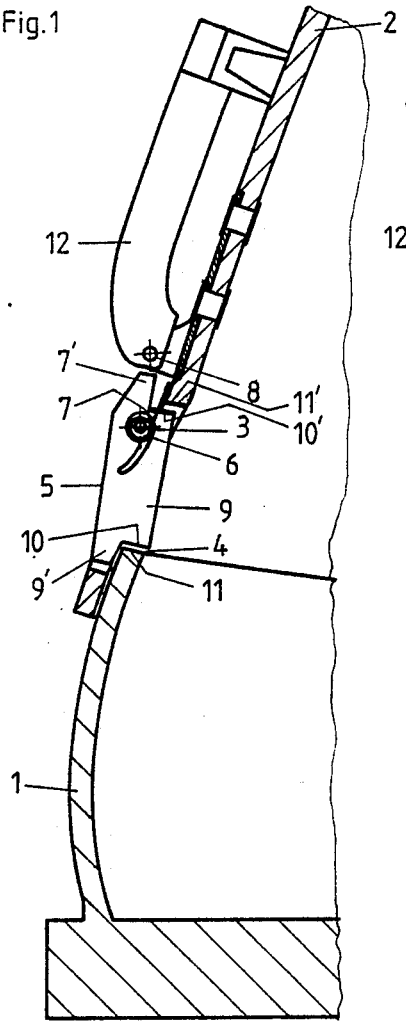
FIG. 1 shows a cross-section through the heel section of the ski boot in the perpendicular longitudinal centre plane in the catch locking position.

FIG. 1 shows a shell 1 and a leg or cover 2 which pivots in the direction of motion about a pin held in shell 1 transverse to the direction of travel. Located between cover 2 and shell 1 is a recess 4 into which a catch 5 rotates about a pin 3. Pin 3 is located on the outside of or in cover 2. Bore 6 in catch 5 has a greater diameter than pin 3, in order to relieve pin 3 of any loads and to prevent pivoting of catch 5 from being hindered as a result of friction between the pin 3 and bore 6. Catch 5 is designed as a double-armed pivoting lever whose short arm 7 is supported on a lower stop face 11′ of cover 2 with its stop face 10′ in the locking position, and whose long arm 9 is supported on an upper stop face 11 of the heel section of shell 1, with its stop face 10 in the locking position. when cover 2 is loaded, the clearance between pin 3 and bore 6 causes a downward force to be transmitted to shell 1 via catch 5 without loading the pin 3. Catch 5 is subjected to the force of at least one spring 14, 15, which forces catch 5 into the locking position, as shown in FIG. 1. In the present configuration one spring 14 or 15 is provided in the vicinity of the two open ends 13 of pin 3 from catch 5, one end 16 being supported on cover 2, while the other end 17 is held in arm 9 supported on shell 1 in the locking position.

Lever 7 acting as a stop cable works together with a clamping lever 12 which pivots about a pin 8 on the outside of cover 2 in the longitudinal centre plane of the ski boot and which leaves the catch unaffected in the engaged position as shown in FIG. 1, so that it is subjected to the force of the two springs 14, 15 in the locking position in which cover 2 is supported on shell 1 via catch 5, with the result that the cover 2 may only pivot forwards and not backwards out of this initial skiing position, in line with the required forward lean. In order to restrict movement of catch 5 in the locking position, arm 9 is provided with an extension 9′ which is supported on the outside of shell 1 on the heel side in the locking position of catch 5 and which can move along the outside of shell 1 on the heel side when cover 2 is opened to allow access. An extension 7′ of arm 7, opposite extension 9′ acts as a stop to limit pivoting of catch 5 into the locking position.

Figure 2:
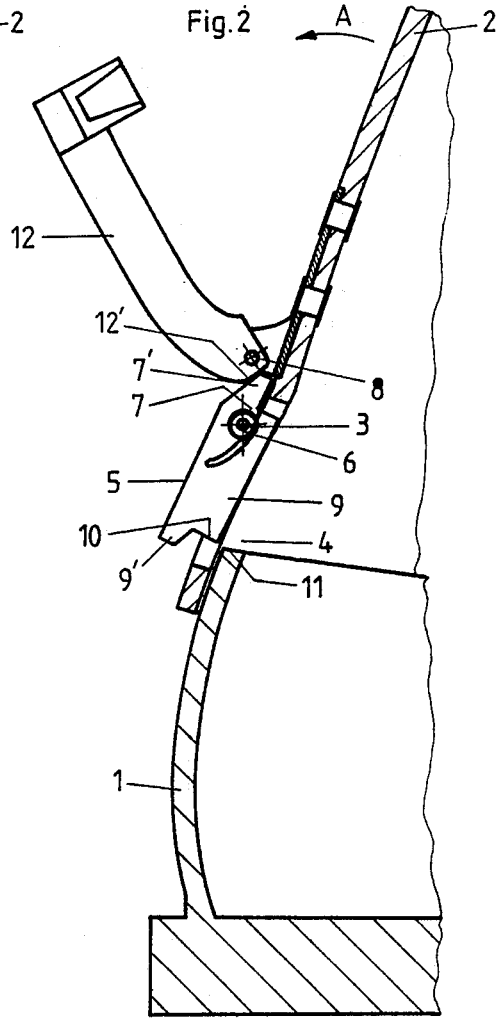
FIG. 2 shows a similar cross-section in the open position of the catch.
Figure 3:
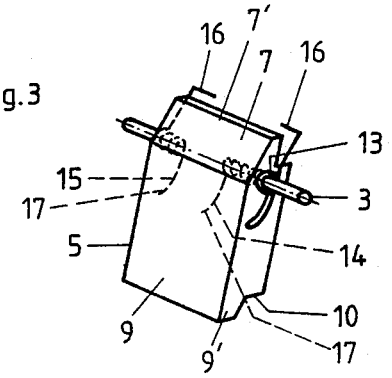
FIG. 3 shows the catch in diagrammatical form.

In order to pivot leg or cover 2 to the rear to allow access into the boot, lever 12 is pivoted into the open position shown in FIG. 2, whereby catch 5 pivots against the force of springs 14, 15, as a result of its arm 12′ applying pressure to arm 7, so that stop face 10 of lever 9 leaves the area of stop face 11 of shell 1 and cover 2 can be pivoted to the rear in the direction of arrow A.

One clamping lever 12 and cover 2 have been pivoted back into their initial positions, springs 14, 15 move catch 5 into the locked position as shown in FIG. 1. The clearance in bore 6 is so great that cover 2 lies on catch 5 and this catch lies on shell 1 in the locked postion of catch 5 and, when cover 2 is loaded in the direction of arrow A, with the result that the pressure of cover 2 is transmitted directly to catch 5 and on to shell 1 without loading pin 3.

The invention is intended primarily for ski boots which are put on from the heel side after pivoting cover 2 to the rear. However, this device may also be used on boots allowing central access where the cover and sleeve can be pivoted to the rear and front respectively or where the boot may only be opened at the front.

I claim:

1. A catch for securing a shell and a leg cover of a ski boot, at least a heel part of the leg cover pivots about an axis extending transverse to a longitudinal axis of the boot, said catch being subjected to a spring force biassing the catch into a closed position and which may be forced against the spring force into an open position, said catch comprising:

a double-armed lever located in a recess of the leg cover and pivoting about a pin having a diameter less than the catch bore in which the pin is located thereby providing a clearance between the pin and the catch bore, and the catch having two stop faces each opposite one stop face of the shell or cover in the closed position of the catch.

2. A catch according to claim 1, wherein the clearance in the bore of the pivoting pin of the catch is so great that when the catch is locked, any backward pressure on the cover is transferred from the cover to the shell via the catch and the pin lays free in the bore.

3. A catch according to claim 1, wherein one arm of said double-armed lever is located in the area of the arm of a clamping level which is hinged on the heel side and which can be pivoted in a vertical longitudinal plane of the ski boot.

4. A catch according to claim 3, wherein the two arms of the double-armed lever are each provided with one extension to limit pivoting of the catch in both directions.

5. A catch according to claim 1, wherein a helical spring is provided on each of the ends of the pin, each spring propping on the leg cover with one end and on the catch with the other end.

* * * * *